US009932996B2

(12) United States Patent
Gratton et al.

(10) Patent No.: US 9,932,996 B2
(45) Date of Patent: Apr. 3, 2018

(54) ELECTROHYDRAULIC IMPLEMENT PRESSURE CUTOFF

(71) Applicant: DEERE & COMPANY, Moline, IL (US)

(72) Inventors: Michael R. Gratton, Dubuque, IA (US); Aaron R. Kenkel, East Dubuque, IL (US)

(73) Assignee: DEERE & COMPANY, Moline, IL (US)

( * ) Notice: Subject to any disclaimer, the term of this patent is extended or adjusted under 35 U.S.C. 154(b) by 292 days.

(21) Appl. No.: 14/971,235

(22) Filed: Dec. 16, 2015

(65) Prior Publication Data

US 2017/0175781 A1 Jun. 22, 2017

(51) Int. Cl.

| | |
|---|---|
| ***F15B 13/04*** | (2006.01) |
| ***F15B 13/044*** | (2006.01) |
| ***F15B 11/08*** | (2006.01) |
| ***E02F 9/22*** | (2006.01) |
| ***E02F 3/42*** | (2006.01) |
| *E02F 3/28* | (2006.01) |

(52) U.S. Cl.

CPC ..... *F15B 13/044* (2013.01); *E02F 3/422* (2013.01); *E02F 9/2228* (2013.01); *F15B 11/08* (2013.01); *F15B 13/0401* (2013.01); *E02F 3/283* (2013.01); *F15B 2211/426* (2013.01)

(58) Field of Classification Search

CPC ..... E02F 3/422; E02F 3/283; E02F 9/2228; F15B 11/08; F15B 13/044; F15B 2211/426; F15B 13/0401; F15B 2211/6336

USPC ..... 60/445, 459, 486

See application file for complete search history.

(56) References Cited

U.S. PATENT DOCUMENTS

| | | | | |
|---|---|---|---|---|
| 3,872,990 | A | 3/1975 | York | |
| 8,056,465 | B2 * | 11/2011 | Carlz | A01C 7/205 91/31 |
| 8,527,158 | B2 * | 9/2013 | Faivre | E02F 9/265 37/411 |
| 8,594,896 | B2 | 11/2013 | Nicholson et al. | |
| 8,813,486 | B2 * | 8/2014 | Peterson | F15B 21/087 60/422 |

(Continued)

OTHER PUBLICATIONS

CAT®, "988K Wheel Loader" brochure, pp. 1-36.

*Primary Examiner* — Thomas E Lazo

(74) *Attorney, Agent, or Firm* — Taft Stettinius & Hollister LLP; Stephen F. Rost

(57) ABSTRACT

An electrohydraulic implement pressure cutoff system is disclosed that includes a pump, one or more hydraulic functions, at least one valve, sensors and control unit. The pump powers the functions, and the valves control flow between the pump and their associated function. The sensor readings indicate system parameters. The control unit receives the readings and controls the valves. When the readings indicate a function is at or beyond a threshold, the control unit closes the associated valve to prevent flow to or from that function. The sensors can be pressure, position or other types of sensors. Operator control signals can be provided to control the functions. When the readings indicate a function is at or beyond a threshold in a stalled direction and the operator signals keep commanding the function in the stalled direction, the control unit can close the associated valve regardless of the operator signals.

20 Claims, 4 Drawing Sheets

(56) References Cited

U.S. PATENT DOCUMENTS

| | | | | |
|---|---|---|---|---|
| 2008/0097672 | A1* | 4/2008 | Clark | E02F 3/434 701/50 |
| 2014/0069091 | A1* | 3/2014 | Franzoni | F15B 11/162 60/422 |

* cited by examiner

ELECTROHYDRAULIC IMPLEMENT PRESSURE CUTOFF

FIELD OF THE DISCLOSURE

The present disclosure relates to hydraulic implements on a machine, and in particular to a system and method for disengaging a hydraulic implement when it has reached its travel limit.

BACKGROUND

In a typical load-sensing implement hydraulic system, when a function is stalled against a hard stop, system pressure increases to some limit. This limit can be specified by a pressure compensator control or a relief valve. If the valve is held open in this condition, high pressure is maintained in the working circuit. In a system that contains only one power source (i.e. pump) to control multiple implement functions, this can result in an unnecessary power loss when an additional function is actuated.

In systems that are hydro-mechanically controlled (i.e. via mechanical levers or pilot controllers), this is unavoidable without additional hardware. In an electrohydraulic (EH) system, however, this scenario can be avoided by forcing the implement valve to shut off under certain conditions. Doing so can alleviate the pressure that resides in the system when other functions are actuated, limiting the excess power that is being spent during these functions.

It would be desirable to be able to shut off a particular hydraulic function under certain conditions to maintain high pressure for that particular function while allowing other functions in the same working circuit to operate at lower pressures.

SUMMARY

An electrohydraulic implement pressure cutoff system is disclosed that includes a hydraulic pump, a first hydraulic function, a first hydraulic valve, a first sensor and a control unit. The first hydraulic function is powered by the hydraulic pump, and the first hydraulic valve controls flow between the hydraulic pump and the first hydraulic function. The first sensor provides first sensor readings that indicate a parameter of the hydraulic system. The control unit receives the first sensor readings and controls the first hydraulic valve. The control unit determines whether the first hydraulic function is at or beyond an end-of-travel position using the first sensor readings, and closes the first hydraulic valve to prevent flow to or from the first hydraulic function when the first hydraulic function is at or beyond the end-of-travel position. The first sensor can be, for example, a pressure sensor where the first sensor readings indicate a working pressure of the first hydraulic function, or a position sensor where the first sensor readings indicate a position of the first hydraulic function.

The electrohydraulic implement pressure cutoff system can also include an operator control that controls the first hydraulic function and provides operator control signals to the control unit. When the control unit determines the first hydraulic function is at or beyond the end-of-travel position in a stalled direction and the operator control signals continue to command the first hydraulic function in the stalled direction, the control unit can close the first hydraulic valve regardless of the operator control signals continuing to command the first hydraulic function in the stalled direction, and the control unit can continue to monitor the first sensor readings and the operator control signals.

The electrohydraulic implement pressure cutoff system can also include a position sensor that provides second sensor readings that indicate a position of the first hydraulic function. The first sensor can be a pressure sensor that provides first sensor readings that indicate a working pressure of the first hydraulic function, or that indicate a load sense pressure of the hydraulic pump, or that indicate a pump outlet pressure of the hydraulic pump, or that indicate another relevant parameter of the hydraulic system. The control unit can receive the first and second sensor readings, and determine whether the first hydraulic function is at or beyond an end-of-travel position using both the first and second sensor readings.

The electrohydraulic implement pressure cutoff system can also include a first function position sensor that provides second sensor readings that indicate a position of the first hydraulic function, a second hydraulic function powered by the hydraulic pump, and a second function position sensor that provides third sensor readings that indicate a position of the second hydraulic function. The second and third sensor readings are also received by the control unit. An embodiment can be configured such that, when the first sensor readings indicate the load sense pressure is at or beyond a load sense pressure threshold, and the second sensor readings indicate the first hydraulic function is at or beyond the end-of-travel position for the first hydraulic function, and the third sensor readings indicate the second hydraulic function is not at or beyond an end-of-travel position for the second hydraulic function, then the control unit can closes the first hydraulic valve to prevent flow to or from the first hydraulic function. The embodiment can also be configured such that, when the first sensor readings indicate the load sense pressure is at or beyond a load sense pressure threshold, and the second sensor readings indicate the first hydraulic function is at or beyond the end-of-travel position for the first hydraulic function, and the third sensor readings indicate the second hydraulic function is at or beyond the end-of-travel position for the second hydraulic function, then the control unit does not close the first hydraulic valve to prevent flow to or from the first hydraulic function.

The electrohydraulic implement pressure cutoff system can also include a second hydraulic function powered by the hydraulic pump, a second hydraulic valve and a second sensor, where the second hydraulic valve controls flow between the hydraulic pump and the second hydraulic function, and the second sensor provides second sensor readings that indicate a parameter of the hydraulic system, the second sensor readings also being received by the control unit. The control unit can determine whether the first hydraulic function is at or beyond the end-of-travel position using at least one of the first and second sensor readings, and can close the first hydraulic valve to prevent flow to or from the first hydraulic function when the first hydraulic function is at or beyond the end-of-travel position. and when at least one of the first and second sensor readings indicate that the second hydraulic function is at or beyond an end-of-travel position, the control unit can close the second hydraulic valve to prevent flow to or from the second hydraulic function. The control unit can determine whether the second hydraulic function is at or beyond the end-of-travel position using at least one of the first and second sensor readings, and can close the second hydraulic valve to prevent flow to or from the second hydraulic function when the second hydraulic function is at or beyond the end-of-travel position. The electrohydraulic implement pressure cutoff system can also include a pressure sensor that provides third sensor readings that indicate a load sense pressure or a pump outlet pressure of the hydraulic pump, and the third sensor readings can also be received by the control unit. The first sensor readings can indicate a parameter of the first hydraulic function; and the second sensor readings can indicate a parameter of the second hydraulic function. The control unit can compare the first sensor readings with a first sensor threshold, compare the second sensor readings with a second sensor threshold, and compare the third sensor readings to a third sensor threshold. When the first sensor readings exceed the first sensor threshold and the third sensor readings exceed the third sensor threshold, the control unit can close the first hydraulic valve to prevent flow to or from the first hydraulic function. When the second sensor readings exceed the second sensor threshold and the third sensor readings exceed the third sensor threshold, the control unit can close the second hydraulic valve to prevent flow to or from the second hydraulic function. The first sensor readings can indicate a position of the first hydraulic function, and the second sensor readings can indicate a position of the second hydraulic function.

After the control unit closes the first hydraulic valve, when the first sensor readings continue to exceed the first sensor threshold and the operator control signals continue to command the first hydraulic function in the stalled direction, the control unit can keeps the first hydraulic valve closed regardless of the third sensor readings. After the control unit closes the first hydraulic valve, when the operator control signals continue to command the first hydraulic function in the stalled direction and the first sensor readings no longer exceed the first sensor threshold, the control unit can command the first hydraulic valve to an actuated position allowing flow from the hydraulic pump to the first hydraulic function. After the control unit closes the first hydraulic valve, when the operator control signals command the first hydraulic function away from the stalled direction, the control unit can command the first hydraulic valve to a release position allowing flow from the first hydraulic function to a hydraulic reservoir.

An electrohydraulic implement pressure cutoff method is disclosed for an electrohydraulic system that includes a hydraulic pump, a hydraulic valve and a hydraulic function. The method includes receiving operator control signals from an operator control that controls the hydraulic function; controlling the hydraulic valve to control flow between the hydraulic pump and the hydraulic function; monitoring a parameter of the hydraulic function using a first sensor that provides first sensor readings; and closing the hydraulic valve to prevent flow to or from the hydraulic function when the first sensor readings indicate that the hydraulic function is at or beyond an end-of-travel position in a stalled direction and the operator control signals continue to command the hydraulic function in the stalled direction.

The first sensor can be a pressure sensor where the first sensor readings indicate a working pressure of the hydraulic function; and the method can also include monitoring a position sensor that provides second sensor readings that indicate a position of the hydraulic function; and closing the hydraulic valve to prevent flow to or from the hydraulic function when at least one of the first and second sensor readings indicate that the hydraulic function is at or beyond the end-of-travel position in the stalled direction and the operator control signals continue to command the hydraulic function in the stalled direction. The first sensor can be a position sensor where the first sensor readings indicate a position of the hydraulic function; and the method can also include monitoring a pressure sensor that provides second sensor readings that indicate a load sense pressure of the hydraulic pump; and closing the hydraulic valve to prevent flow to or from the hydraulic function when the first sensor readings indicate that the hydraulic function is at or beyond the end-of-travel position in the stalled direction, the second sensor readings indicate that the load sense pressure of the hydraulic pump is at or beyond a load sense pressure threshold, and the operator control signals continue to command the hydraulic function in the stalled direction.

The method can also include keeping the hydraulic valve in the closed position to prevent flow to or from the hydraulic function while the first sensor readings continue to indicate that the hydraulic function is at or beyond the end-of-travel position in the stalled direction and the operator control signals continue to command the hydraulic function in the stalled direction; opening the hydraulic valve to allow flow from the hydraulic pump to the hydraulic function, when the operator control signals continue to command the hydraulic function in the stalled direction and the first sensor readings indicate that the hydraulic function is no longer at or beyond the end-of-travel position in the stalled direction; and moving the hydraulic valve to allow flow from the hydraulic function to a hydraulic reservoir, when the operator control signals command the hydraulic function away from the stalled direction.

An electrohydraulic implement pressure cutoff method is disclosed for an electrohydraulic system that includes a hydraulic pump, a hydraulic valve and a hydraulic function. The method includes receiving operator control signals from an operator control that controls the hydraulic function; monitoring a pressure of the hydraulic system using a pressure sensor; entering a no operator command mode when no function control signals are received; entering a normal operating mode when function control signals are received and the monitored pressure of the hydraulic system is below a pressure threshold; in normal operating mode, generating valve commands for the hydraulic valve based on the operator control signals; entering a pressure cutoff mode when the operator control signals indicate increased flow to the hydraulic function and the monitored pressure of the hydraulic system is greater than or equal to the pressure threshold; in pressure cutoff mode, closing the hydraulic valve to prevent flow to or from the hydraulic function. The electrohydraulic implement pressure cutoff method can also include monitoring a position of the hydraulic function using a position sensor; entering the normal operating mode when the operator control signals are received and the position of the hydraulic function is below a position threshold; and wherein entering the pressure cutoff mode also requires the position of the hydraulic function to be greater than or equal to the position threshold. The electrohydraulic implement pressure cutoff method can also include monitoring a position of the hydraulic function using a position sensor; entering the pressure cutoff mode when the operator control signals indicate increased flow to the hydraulic function and the position of the hydraulic function is greater than or equal to a position threshold; and wherein entering the normal operating mode also requires the position of the hydraulic function to be below the position threshold.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Figure 1:
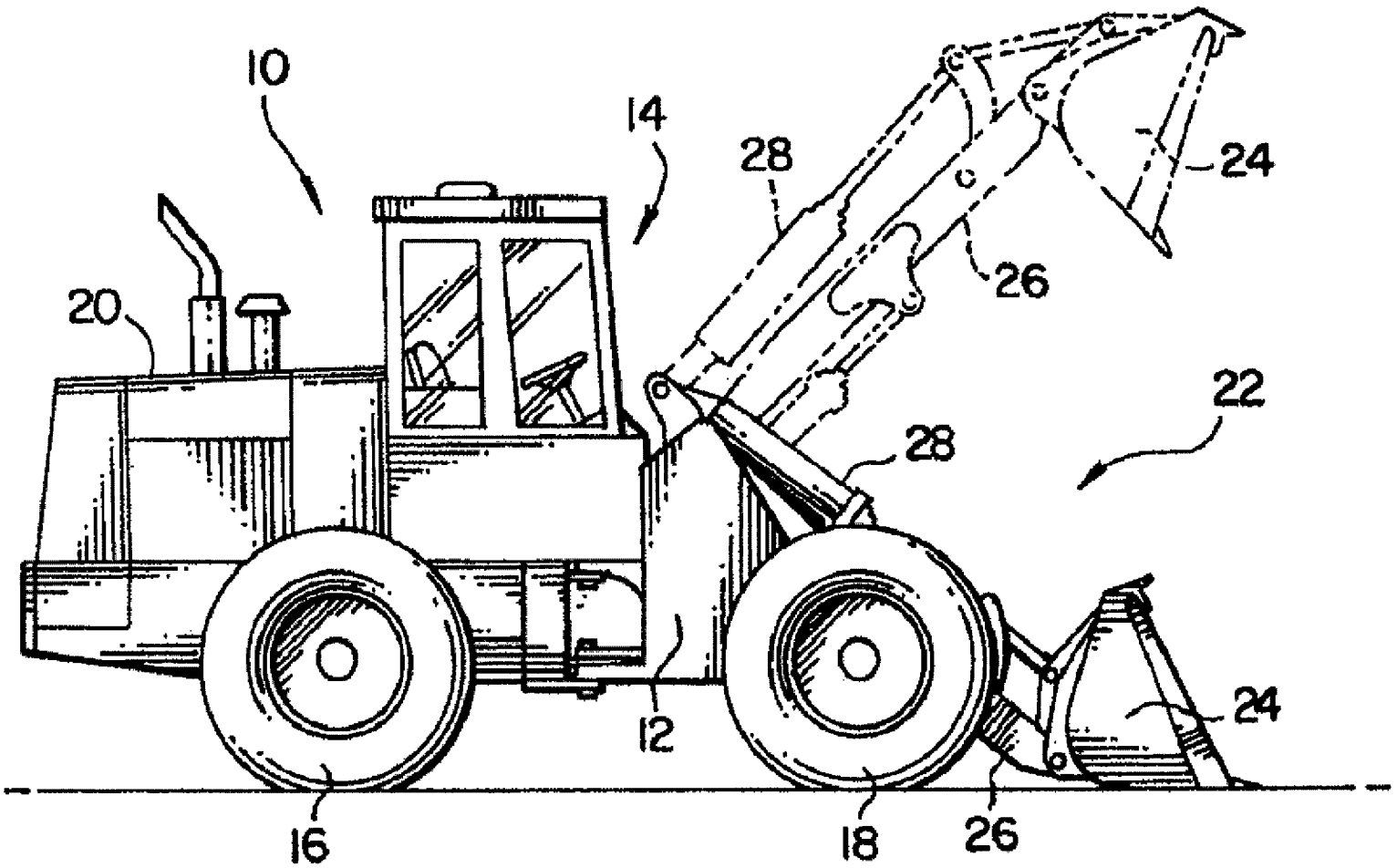
FIG. 1 illustrates an exemplary loader vehicle.

FIG. 1 illustrates an exemplary loader 10 for scooping and dumping material. The loader 10 includes an articulated chassis 12, an operator cab 14 supported by the chassis 12, rear wheels 16 and front wheels 18 to propel the loader 10, an engine 20 to power operation of loader 10, and a boom assembly 22. The boom assembly 22 includes a bucket 24, boom linkages 26, and a tilt cylinder 28. The loader 10 could include other traction devices, for example continuous tracks, instead of wheels 16, 18 as shown in FIG. 1 to propel the loader 10.

Although a loader is discussed, the features described herein may be provided on other vehicles such as bulldozers, motor graders, and other construction vehicles having various construction tools and traction devices. The vehicle may also be an agricultural vehicle, such as a tractor, combine, or other agriculture vehicle. The bucket 24 is described as a construction implement that scoops and dumps materials, such as dirt, sand, gravel, salt, snow, and other materials. Other hydraulic implements, for example, blades, pallet forks, bail lifts, augers, plows, trailers, planters, corn heads, cutting platforms, and other tools may also be provided.

Figure 2:
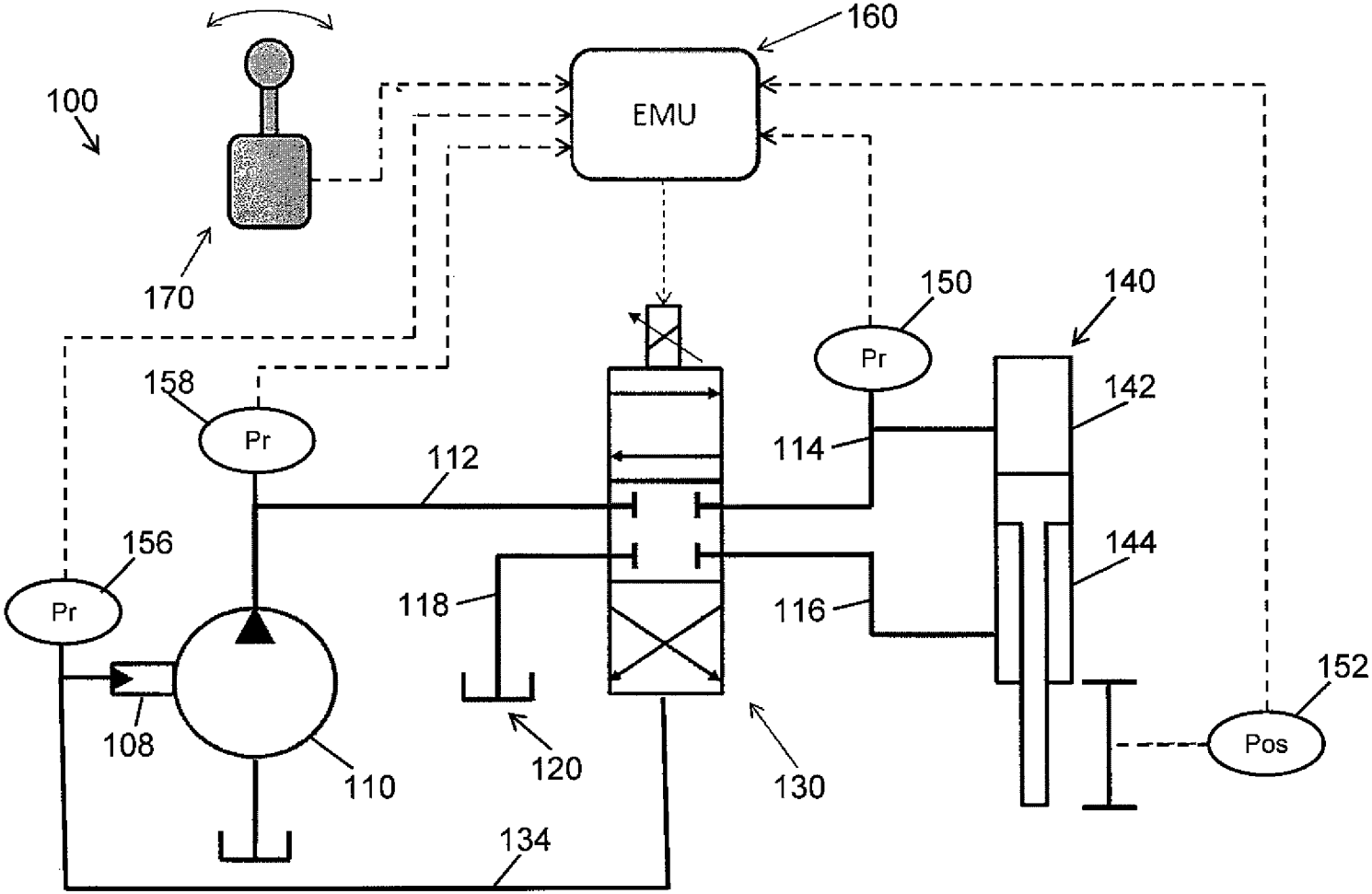
FIG. 2 illustrates an exemplary electrohydraulic (EH) implement pressure cutoff system that can be used on a loader or other vehicle having a hydraulic circuit with a pump providing flow to an implement.
Figure 3:
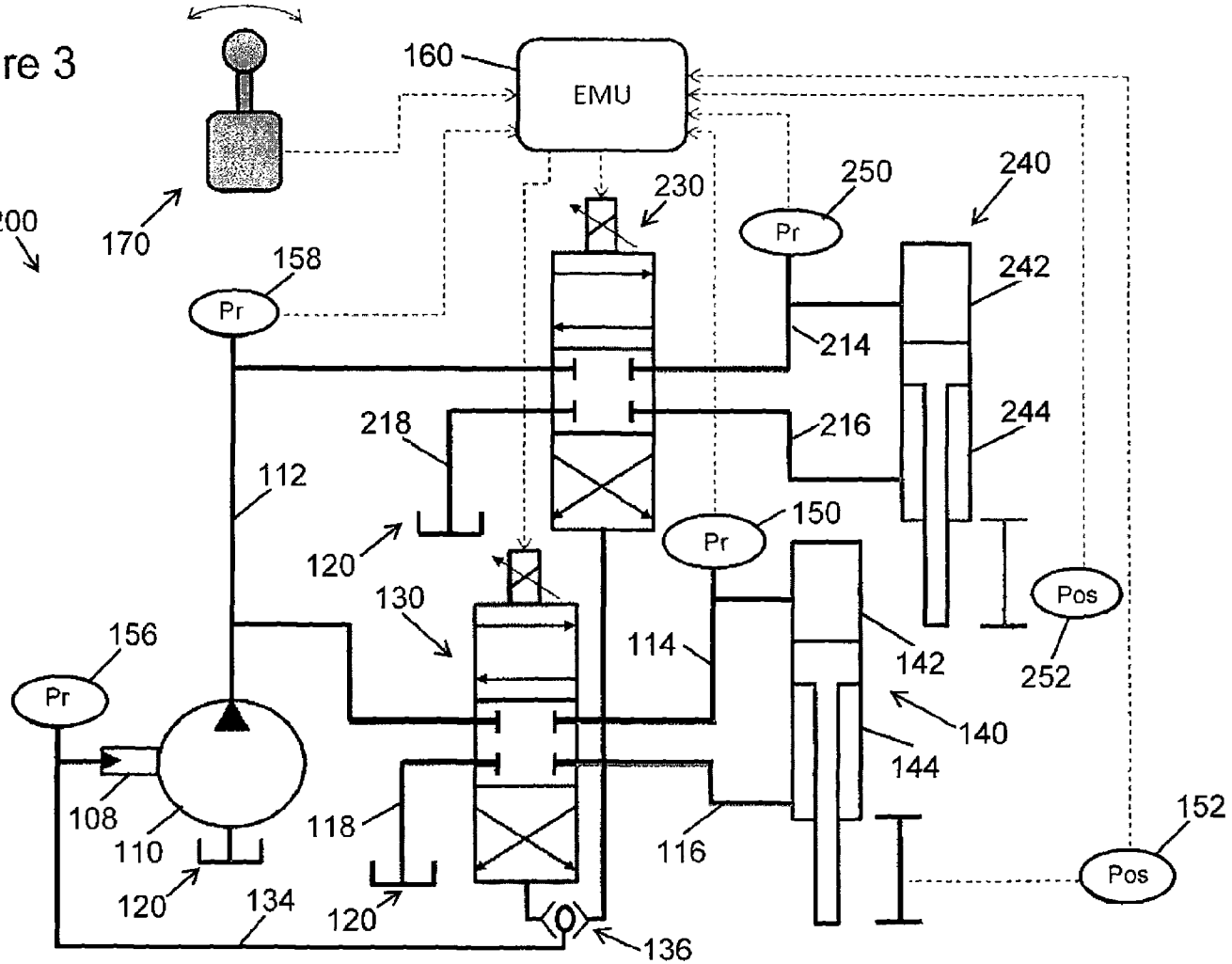
FIG. 3 illustrates an exemplary electrohydraulic (EH) implement pressure cutoff system that can be used on a loader or other vehicle having a hydraulic circuit with a pump providing flow to multiple implements.

FIGS. 2 and 3 illustrate exemplary electrohydraulic (EH) implement pressure cutoff systems that can be used on the loader 10 or other vehicle having a hydraulic circuit. The exemplary EH implement pressure cutoff system 100 of FIG. 2 shows a hydraulic pump 110 powering one hydraulic function 140, while the exemplary EH implement pressure cutoff system 200 of FIG. 3 shows the hydraulic pump 110 powering multiple hydraulic functions 140, 240 for example a boom and a bucket of a loader. The EH implement pressure cutoff system can be used with a pump powering one or more hydraulic functions.

The EH implement pressure cutoff system 100 includes the hydraulic pump 110, a fluid reservoir 120, a hydraulic valve 130, the hydraulic function 140, and one or more sensors 150-158 monitoring one or more parameters of the hydraulic system 100. The hydraulic valve 130 controls flow between the pump 110 and the hydraulic function 140, and between the hydraulic function 140 and the reservoir 120. The hydraulic valve 130, represented by a three position/two way valve, can allow flow or cutoff flow between the hydraulic pump 110 and the hydraulic function 140. The hydraulic function 140 is represented by a lift cylinder having a piston head side 142 and a piston rod side 144.

A pump outlet line 112 hydraulically couples the pump 110 to the valve 130, a working line 114 hydraulically couples the valve 130 to the piston head side 142 of the hydraulic function 140, a function outlet line 116 hydraulically couples the piston rod side 144 of the hydraulic function 140 to the valve 130, and a reservoir line 118 hydraulically couples the valve 130 to the reservoir 120. One or more additional hydraulic functions can be connected to the pump outlet line 112 to receive flow from the hydraulic pump 110. The hydraulic pump 110 can be electronically or hydro-mechanically controlled. A load sense line 134 hydraulically couples a hydraulic control 108 of the pump 110 to the valve 130.

The hydraulic valve 130 can be directly or indirectly electronically controlled, for example by an electromechanical control unit (EMU) 160 directly controlling a solenoid included in the hydraulic valve 130. Alternatively, the hydraulic valve 130 may be piloted by a separate valve which in turn is directly or indirectly electronically controlled by the EMU 160. The EMU 160 can also receive the readings from the sensors 150-158. An operator control 170, for example a lever, can be used by a vehicle operator to provide operator input commands to the EMU 160 for the hydraulic function 140. In such a system, it may be customary to include various sensors for understanding operating states and for automating control features. For example, on the four-wheel drive (4WD) loader 10, position sensors can be used to understand the location of various elements of the implement linkages 26 or the tilt cylinder 28, and hydraulic pressure sensors can be installed in various locations in order to understand the operating state of the hydraulic system.

The exemplary EH implement pressure cutoff system embodiment 100 includes four sensors 150, 152, 156, 158 monitoring various parameters of the hydraulic system 100. Different EH implement pressure cutoff system embodiments can include more or less sensors. A working line pressure sensor 150 monitors a working pressure in the working line 114 between the valve 130 and the piston head side 142 of the hydraulic function 140. A function position sensor 152 monitors a position of the hydraulic function 140. The function position sensor 152 can monitor a position, angle, or other position-related parameter, either relative or absolute, regarding the hydraulic function. A pump outlet pressure sensor 158 monitors a pump outlet pressure in the pump outlet line 112 between the pump 110 and the valve 130. A load sense pressure sensor 156 monitors a load sense pressure in the load sense line 134 between the pump hydraulic control 108 and the valve 130.

FIG. 3 shows an exemplary EH implement pressure cutoff system 200 that includes the components above for the EH implement pressure cutoff system 100, and additional components for the second hydraulic function 240. The EH implement pressure cutoff system 200 includes the hydraulic pump 110, the fluid reservoir 120, the first hydraulic valve 130, the first hydraulic function 140, a second hydraulic valve 230, the second hydraulic function 240, the one or more sensors 150-158 and additional sensors 250, 252 monitoring one or more parameters of the hydraulic system 200. The hydraulic valve 230 controls flow between the pump 110 and the hydraulic function 240, and between the hydraulic function 240 and the reservoir 120. The hydraulic valve 230, represented by a three position/two way valve, can allow flow or cutoff flow between the hydraulic pump 110 and the hydraulic function 240. The hydraulic function 240 is represented by a lift cylinder having a piston head side 242 and a piston rod side 244.

The pump outlet line 112 hydraulically couples the pump 110 to both the first and second valves 130, 230. The first working line 114 hydraulically couples the first valve 130 to the piston head side 142 of the first hydraulic function 140, the first function outlet line 116 hydraulically couples the piston rod side 144 of the first hydraulic function 140 to the first valve 130, and the first reservoir line 118 hydraulically couples the first valve 130 to the reservoir 120. A second working line 214 hydraulically couples the second valve 230 to the piston head side 242 of the second hydraulic function 240, a second function outlet line 216 hydraulically couples the piston rod side 244 of the second hydraulic function 240 to the second valve 230, and a second reservoir line 218 hydraulically couples the second valve 230 to the reservoir 120. The hydraulic pump 110 can be electronically or hydro-mechanically controlled. A load sense line 134 hydraulically couples a hydraulic control 108 of the pump 110 to the first and second valves 130, 230 through a shuttle valve 136. The shuttle valve 136 selects the higher of the load sense pressures from the first and second valves 130, 230.

The first and second hydraulic valves 130, 230 can be directly or indirectly electronically controlled, for example by the electromechanical control unit (EMU) 160, and the EMU 160 can also receive the readings from the sensors 150-158, 250, 252. The operator control 170 can be used by the vehicle operator to provide operator input commands to the EMU 160 for the hydraulic functions 140, 240.

The exemplary EH implement pressure cutoff system embodiment 200 includes the six sensors 150, 152, 156, 158, 250, 252 monitoring various parameters of the hydraulic system 200. Different EH implement pressure cutoff system embodiments can include more or less sensors. The first working line pressure sensor 150 monitors a working pressure in the first working line 114 between the first valve 130 and the piston head side 142 of the first hydraulic function 140. The first function position sensor 152 monitors a position of the first hydraulic function 140. The second working line pressure sensor 250 monitors a working pressure in the second working line 214 between the second valve 230 and the piston head side 242 of the second hydraulic function 240. The second function position sensor 252 monitors a position of the second hydraulic function 240. The first and second function position sensors 152, 252 can monitor a position, angle, or other position-related parameter, either relative or absolute, regarding the first and second hydraulic function 140, 240, respectively. The pump outlet pressure sensor 158 monitors a pump outlet pressure in the pump outlet line 112 from the pump 110 to the first and second valves 130, 230. The load sense pressure sensor 156 monitors a load sense pressure in the load sense line 134 between the pump hydraulic control 108 and the first and second valves 130, 230.

When an operator uses the operator control 170 to command the first hydraulic function 140 to extend or lift, the top position of the first valve 130 is used to allow flow from the pump 110 through the pump outlet line 112 and the first valve 130 to increase the working pressure in the first working line 114 on the piston head side. 142 and extend the first actuator 140. The first valve 130 also allows return flow from the piston rod side 144 of the first actuator 140 through the first return line 116, first valve 130 and first reservoir line 118 to the hydraulic reservoir 120. While the pump 110 is providing flow to the first hydraulic actuator 140, the first working pressure sensor 150 monitors the working pressure in the first working line 114, and the first function position sensor 152 monitors the position of the first actuator 140. Also during this time, the pump outlet pressure sensor 158 monitors the pump outlet pressure in the pump outlet line 112, and the load sense pressure sensor 156 monitors the load sense pressure in the load sense line 134.

When an operator uses the operator control 170 to command the second hydraulic function 240 to extend or lift, the top position of the second valve 230 is used to allow flow from the pump 110 through the pump outlet line 112 and the second valve 230 to increase the working pressure in the second working line 214 on the piston head side 242 and extend the second actuator 240. The second valve 230 also allows return flow from the piston rod side 244 of the second actuator 240 through the second return line 216, second valve 230 and second reservoir line 218 to the hydraulic reservoir 120. While the pump 110 is providing flow to the second hydraulic actuator 240, the second working pressure sensor 250 monitors the working pressure in the second working line 214, and the second function position sensor 252 monitors the position of the second actuator 240. Also during this time, the pump outlet pressure sensor 158 monitors the pump outlet pressure in the pump outlet line 112, and the load sense pressure sensor 156 monitors the load sense pressure in the load sense line 134.

When the first hydraulic function 140 has reached a threshold or limit, for example full extension or retraction, where it is stalled at a hard stop or other end-of-travel condition, it is no longer beneficial to continue to add pressure to the first hydraulic function 140 in the stalled direction. When the second hydraulic function 240 has reached a threshold or limit, for example full extension or retraction, where it is stalled at a hard stop or other end-of-travel condition, it is no longer beneficial to continue to add pressure to the second hydraulic function 240 in the stalled direction. The end-of-travel can include, for example, a minimum retraction or maximum extension of a hydraulic cylinder, a maximum position of a hydraulic motor, or a stop for a linkage/structure of the hydraulic function. The end-of-travel position of the first hydraulic function 140 can be determined by various methods including for example one or more of, readings from the first working line pressure sensor 150 that the working pressure has reached or exceeded a first working pressure threshold, readings from the first function position sensor 152 that the position of the first hydraulic function 140 has reached or exceeded a first function position threshold, readings from the pump outlet pressure sensor 158 that the pump outlet pressure has reached or exceeded a pump outlet pressure threshold, or readings from the load sense pressure sensor 156 that the load sense pressure has reached or exceeded a load sense pressure threshold. The end-of-travel position of the second hydraulic function 240 can be determined by various methods including for example one or more of, readings from the second working line pressure sensor 250 that the working pressure has reached or exceeded a second working pressure threshold, readings from the second function position sensor 252 that the position of the second hydraulic function 140 has reached or exceeded a second function position threshold, readings from the pump outlet pressure sensor 158 that the pump outlet pressure has reached or exceeded a pump outlet pressure threshold, or readings from the load sense pressure sensor 156 that the load sense pressure has reached or exceeded a load sense pressure threshold. The EH implement pressure cutoff system 100 can use one or a combination of these example ways to determine if the first hydraulic function 140 has reached an end-of-travel condition. The EH implement pressure cutoff system 200 can use one or a combination of these example ways to determine if the first and/or second hydraulic functions 140, 240 have reached an end-of-travel condition.

If the first hydraulic function 140 has reached an end-of-travel condition, the first valve 130 can be latched off or moved to the middle position where flow through the first valve 130 to and from the first hydraulic function 140 is cutoff. This latching off can be maintained even if the operator continues to command the first hydraulic function 140 in the stalled direction. While the first valve 130 is in the middle position, the working pressure in the first working line 114 between the first valve 130 and the piston head side 142 of the first actuator 140 should remain generally stable, and the position of the first hydraulic function should remain generally stable. Thus, the readings from the first working line pressure sensor 150 and the first function position sensor 152 should remain generally stable at the threshold or limit while they continue to monitor the conditions of the first hydraulic function 140. Also during this time, the pump outlet pressure and the load sense pressure should decrease. Thus, the readings from the pump outlet pressure sensor 158 and the load sense pressure sensor 156 should drop. This enables other hydraulic functions powered by the pump 110 through the pump outlet line 112 to operate at a lower pressure than the stalled working pressure in the first working line 114, which conserves power. In the embodiment of FIG. 3, when the load sense pressure of the first valve 130 is greater than the load sense pressure of the second valve 230, the shuttle valve 136 shifts so that the load sense pressure sensor 156 senses the load sense pressure of the first valve 130. When the first valve 130 is latched closed in the middle position, the load sense pressure of the first valve 130 drops and when the load sense pressure of the second valve 230 becomes greater than the load sense pressure of the first valve 130 the shuttle valve 136 shifts so that the load sense pressure sensor 156 senses the load sense pressure of the second valve 230.

Using one or both of the first working line pressure sensor 150 and the first function position sensor 152, if the operator continues to issue operator commands using the control 170 to move the first hydraulic function 140 in the end-of-travel direction while the sensors 150, 152 indicate that the first hydraulic function 140 is already at or beyond the end-of-travel position in that stalled direction, the control unit 160 can keep the first hydraulic valve 130 latched closed. If the operator continues to issue operator commands using the control 170 to move in the end-of-travel condition and the sensors 150, 152 indicate that the first hydraulic function 140 is no longer at or beyond the end-of-travel position in the stalled direction, the control unit 160 can move the first hydraulic valve 130 back to the top position to bring the first hydraulic function 140 back to the end-of-travel position in the operator commanded direction.

If the second hydraulic function 240 has reached an end-of-travel condition, the second valve 230 can be latched off or moved to the middle position where flow through the second valve 230 to and from the second hydraulic function 240 is cutoff. This latching off can be maintained even if the operator continues to command the second hydraulic function 240 in the stalled direction. While the second valve 230 is in the middle position, the working pressure in the second working line 214 between the second valve 230 and the piston head side 242 of the second actuator 240 should remain generally stable, and the position of the second hydraulic function should remain generally stable. Thus, the readings from the second working line pressure sensor 250 and the second function position sensor 252 should remain generally stable at the threshold or limit while they continue to monitor the conditions of the second hydraulic function 240. Also during this time, the pump outlet pressure and the load sense pressure should decrease. Thus, the readings from the pump outlet pressure sensor 158 and the load sense pressure sensor 152 should drop. This enables other hydraulic functions powered by the pump 110 through the pump outlet line 112 to operate at a lower pressure than the stalled working pressure in the second working line 214, which conserves power. In the embodiment of FIG. 3, when the load sense pressure of the second valve 230 is greater than the load sense pressure of the first valve 130, the shuttle valve 136 shifts so that the load sense pressure sensor 156 senses the load sense pressure of the second valve 230. When the second valve 230 is latched closed in the middle position, the load sense pressure of the second valve 230 drops and when the load sense pressure of the first valve 130 becomes greater than the load sense pressure of the second valve 230 the shuttle valve 136 shifts so that the load sense pressure sensor 156 senses the load sense pressure of the first valve 130.

Using one or both of the second working line pressure sensor 250 and the second function position sensor 252, if the operator continues to issue operator commands using the control 170 to move the second hydraulic function 240 in the end-of-travel direction while the sensors 250, 252 indicate that the second hydraulic function 240 is already at or beyond the end-of-travel position in that stalled direction, the control unit 160 can keep the second hydraulic valve 230 latched closed. If the operator continues to issue operator commands using the control 170 to move in the end-of-travel condition and the sensors 250, 252 indicate that the second hydraulic function 240 is no longer at or beyond the end-of-travel position in the stalled direction, the control unit 160 can move the second hydraulic valve 230 back to the top position to bring the second hydraulic function 240 back to the end-of-travel position in the operator commanded direction.

The thresholds or limits of the first and second hydraulic functions 140, 240 do not need to be their actual physical limits, but can leave some margin, for example the monitored thresholds or limits can be some percentage, for example 95%, of the physical limits.

Using the pump outlet pressure sensor 158 or the load sense pressure sensor 156, optionally with one or both of the first working line or first function position sensors 150, 152, if the operator continues to issue operator commands using the control 170 to move the first hydraulic function 140 in the end-of-travel direction after the sensors have already indicated that the first hydraulic function 140 has already reached or exceeded the end-of-travel position in that stalled direction without ceasing commands in the end-of-travel direction or issuing commands away. from the end-of-travel direction, then the control unit 160 can keep the first hydraulic valve 130 latched closed. The control unit 160 can wait for the operator to cease issuing commands in the end-of-travel direction or start issuing commands away from the end-of-travel direction for the first hydraulic function 140 before returning control of the first hydraulic function 140 to the operator.

Using the pump outlet pressure sensor 158 or the load sense pressure sensor 156, optionally with one or both of the second working line or second function position sensors 250, 252, if the operator continues to issue operator commands using the control 170 to move the second hydraulic function 240 in the end-of-travel direction after the sensors have already indicated that the second hydraulic function 240 has already reached or exceeded the end-of-travel position in that stalled direction without ceasing commands in the end-of-travel direction or issuing commands away from the end-of-travel direction, then the control unit 160 can keep the second hydraulic valve 230 latched closed. The control unit 160 can wait for the operator to cease issuing commands in the end-of-travel direction or start issuing commands away from the end-of-travel direction for the second hydraulic function 240 before returning control of the second hydraulic function 240 to the operator.

When the pump outlet pressure sensor 158 or the load sense pressure sensor 156 reaches or exceeds a pressure limit or threshold in a hydraulic system powering multiple hydraulic functions (for example, EH system 200), these readings alone may not indicate which particular function is driving it to high pressure. The control unit 160 can track the position of the functions actuated by the pump 110, for example both the first and second function positions monitored by the readings from the first and second function position sensors 152, 252 to determine if one of the hydraulic functions 140, 240 or some other issue is driving up the relevant pressure of the pump 110. For example, in a system where the pump 110 is only powering the first hydraulic function 140 and the second hydraulic function 240, where the first hydraulic function 140 is the boom and the second hydraulic function 240 is the bucket, and the operator is holding the bucket in a stalled position, it could falsely be assumed that the boom is commanding the elevated pump outlet or load sense pressure, which could lead to prematurely stopping the boom from raising once the boom reaches or passes its position threshold monitored by the first function position sensor 152. In this case, the system 200 can monitor the second function position sensor 252 of the bucket (second hydraulic function 240) to infer that the pump 110 is actually driven to its pump outlet or load sense pressure threshold by the bucket, and that the raise function of the boom (first hydraulic function 140) should not be turned off until the bucket is no longer being commanded in the stalled direction.

When the operator issues operator commands using the control 170 to move a stalled hydraulic function away from its end-of-travel condition, the control unit can command the appropriate hydraulic valve to move to the bottom position to allow flow from the piston head side of the hydraulic function through the function outlet line, valve and reservoir line to the hydraulic reservoir in order to allow the hydraulic actuator to retract. For example, if the first hydraulic function 140 has been stalled and the valve 130 latched in its center position, when the operator commands using the control 170 to move the stalled first hydraulic function 140 away from its end-of-travel condition, the control unit 160 can command the first hydraulic valve 130 to move to the bottom position to allow flow from the piston head side 142 of the first hydraulic function 140 through the first function outlet line 116, valve 130 and reservoir line 118 to the hydraulic reservoir 120 in order to allow the hydraulic actuator 140 to retract. During this time, the sensors can continue to monitor the conditions of the hydraulic system.

Using the sensors, the system can determine whether or not the operator of the machine is stalling a hydraulic function at high pressure at the end of its full range of travel. For example, logic can be implemented to detect this particular circumstance by observing one or more of the following conditions:

- pump outlet pressure in the pump outlet line is above a pump outlet pressure threshold;
- working pressure in a working line is above a working pressure threshold;
- load sense pressure in the load sense line is above a load sense pressure threshold;
- position of a hydraulic function (implement) is at or near the end of its known full range of travel;
- the operator is continuing to command the implement in the stalled direction.

In this scenario, it can be determined that the operator is not getting useful work out of the implement in question, and the valve controlling that implement can be shut off. Shutting off the valve controlling the implement in question reduces the operating pressure of the pump, which conserves power when other functions are actuated.

Figure 4:
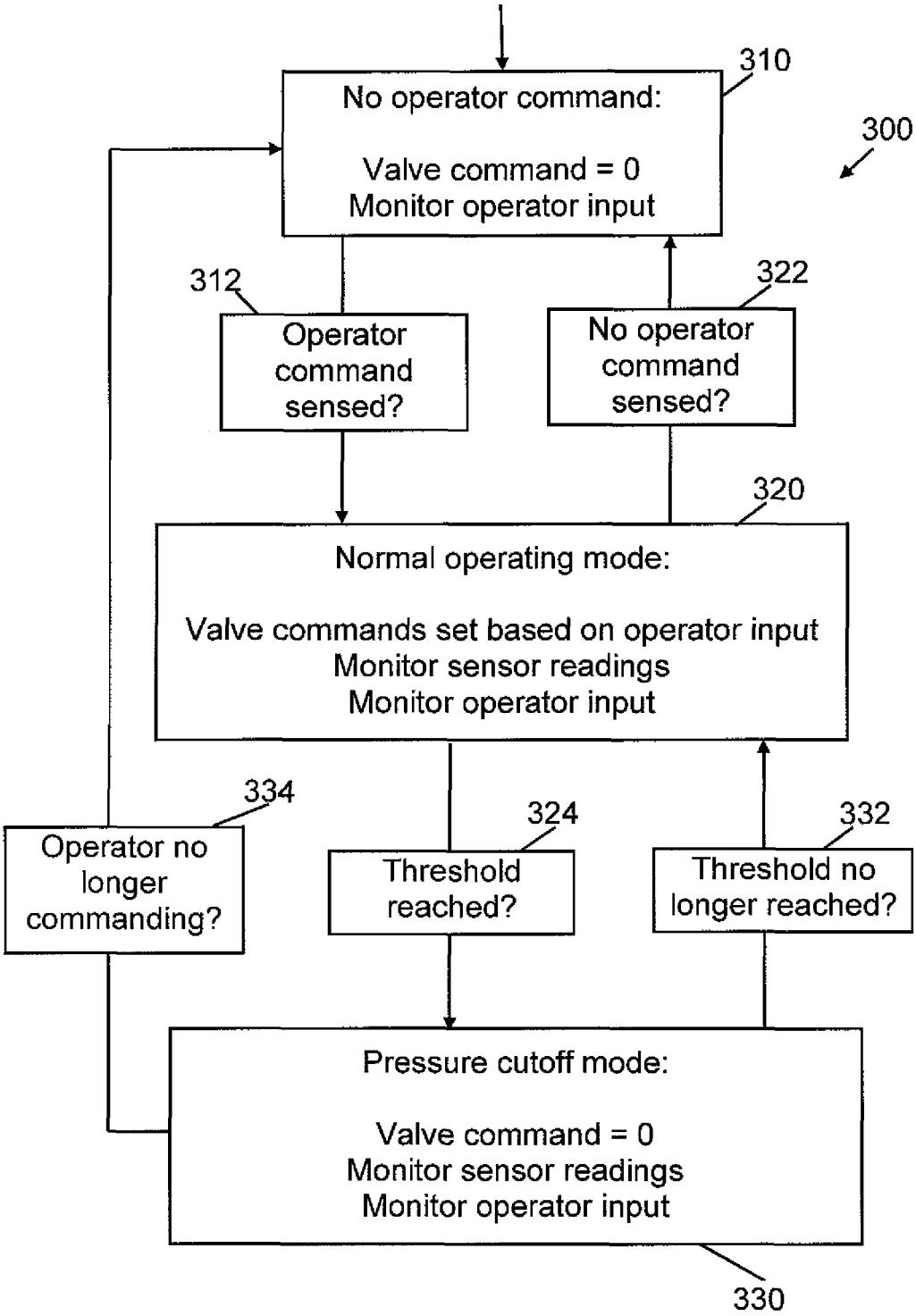
FIG. 4 shows an exemplary control flow for the exemplary EH implement pressure cutoff system.

FIG. 4 shows an exemplary control flow 300 for an exemplary EH implement pressure cutoff system. The control flow 300 will be described with reference to the first hydraulic function 140 for clarity, but it can also be applied to the second or other hydraulic function in an EH system. The control flow 300 includes three modes: no operator command mode 310, a normal operating mode 320 and a pressure cutoff mode 330.

Control starts in the no operator command mode 310 where there is no operator command using the operator control 170, and thus no command for the first valve 130. The system monitors the operator input, and when an operator command is detected control passes through block 312 to the normal operating mode 320.

In the normal operating mode 320, the valve commands for the first hydraulic valve 130 are set based on the operator input. The system, for example EMU 160, monitors the readings of one or more of the sensors 150-158 and the operator input 170. If operator commands are no longer detected, then control passes through block 322 back to the no operator command mode 310. However, if the sensors 150-158 indicate that the first hydraulic function 140 has reached a threshold, then control passes through block 324 to the pressure cutoff mode 330. One or more conditions of the hydraulic function can be monitored to determine when a threshold is reached. For example, FIG. 2 shows a first working pressure sensor 150 monitoring a working pressure of the first hydraulic function 140, a first function position sensor 152 monitoring a position of the first hydraulic function 140, a load sense pressure sensor 156 monitoring a load sense pressure of the pump 110, and a pump outlet pressure sensor 150 monitoring a pump outlet pressure of the hydraulic pump 110. Moving from the normal operating mode 320 to the pressure cutoff mode 330 may require just one sensor to indicate that the first hydraulic function 140 has reached or exceeded a threshold, or it may require a combination of multiple sensors to indicate that the first hydraulic function 140 has reached or exceeded a threshold.

In the pressure cutoff mode 330, the control unit 160 commands the first hydraulic valve 130 to latch closed to cut off flow to and from the first hydraulic function 140, for example as illustrated by the middle position of the first valve 130. This can be done even if the operator continues to command the first hydraulic function 140 in the stalled direction. The system continues to monitor the readings of the sensors 150-158 and the operator input 170. If the operator stops commanding the first hydraulic function 140 to move in the stalled direction, then control passes through block 334 back to the no operator command mode 310. In block 334, the first valve 130 would be unlatched to allow the first valve 130 to be returned to normal operation by operator control.

In the pressure cutoff mode 330, in embodiments using one or both of the first working line pressure sensor 150 and the first function position sensor 152, if the required threshold(s) for the pressure cutoff mode 230 for these sensors 150, 152 are no longer met, then control can pass through block 332 back to the normal operating mode 320. When the first valve 130 is latched closed, the readings from the first working line pressure sensor 150 and the first function position sensor 152 should remain substantially stable at the relevant threshold(s). However, when the first valve 130 is latched closed, the readings from the load sense pressure sensor 156 and the pump outlet pressure sensor 152 should decrease making a continued comparison to their threshold inappropriate for remaining in the pressure cutoff mode 330. As long as the operator continues to command additional flow to the stalled hydraulic function 140 and the necessary threshold(s) are detected by the sensors, the system will remain in the pressure cutoff mode 330 where flow between the pump 110 and the first hydraulic function 140 is cut off by the first valve 130 to reduce power requirements. In the test to pass from the pressure cutoff mode 330 to the normal operating mode 320, the threshold(s) can be reduced by a hysteresis value. For example, the pressure threshold can be reduced by a pressure hysteresis value and/or the position threshold can be reduced by a position hysteresis value. Alternatively, moving out of the pressure cutoff mode 330 may require the operator to stop issuing commands to the first hydraulic function 140 which returns control through block 334 to the no operator command mode 310 where the valve is unlatched and the operator again commands the function. This alternative helps prevent the hydraulic function from cycling on and off continuously as pressure in the system gradually fluctuates.

This system and method can improve fuel economy during certain operations where operators are prone to unnecessarily hold a function in its stalled position. As an example, an inexperienced operator may stall the boom of a loader in the fully raised position as they approach a truck during a truck loading cycle. During the truck loading cycle, when material is dumped into the bed of the truck, the implement pump flows oil to the bucket control circuit. If the boom is being held in the stalled position, the pump has to provide this flow at a high pressure, thus consuming more power than is necessary for this application. The disclosed system and method could cut off flow from the pump to the boom lift cylinder and allow the flow to the bucket control circuit to be at a lower pressure.

While the disclosure has been illustrated and described in detail in the drawings and foregoing description, such illustration and description is to be considered as exemplary and not restrictive in character, it being understood that illustrative embodiment(s) have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

We claim:

1. An electrohydraulic implement pressure cutoff system comprising:

a hydraulic pump;

a first hydraulic function powered by the hydraulic pump;

a first hydraulic valve that controls flow between the hydraulic pump and the first hydraulic function;

a first sensor that provides first sensor readings that indicate a parameter of the hydraulic system; and a control unit that receives the first sensor readings and controls the first hydraulic valve;

wherein the control unit determines whether the first hydraulic function is at or beyond an end-of-travel position using the first sensor readings, and closes the first hydraulic valve to prevent flow to or from the first hydraulic function when the first hydraulic function is at or beyond the end-of-travel position.

2. The electrohydraulic implement pressure cutoff system of claim 1, wherein the first sensor is a pressure sensor and the first sensor readings indicate a working pressure of the first hydraulic function.

3. The electrohydraulic implement pressure cutoff system of claim 1, wherein the first sensor is a position sensor and the first sensor readings indicate a position of the first hydraulic function.

4. The electrohydraulic implement pressure cutoff system of claim 1, further comprising an operator control that controls the first hydraulic function and provides operator control signals to the control unit; and wherein when the control unit determines the first hydraulic function is at or beyond the end-of-travel position in a stalled direction and the operator control signals continue to command the first hydraulic function in the stalled direction, the control unit closes the first hydraulic valve regardless of the operator control signals continuing to command the first hydraulic function in the stalled direction, and the control unit continues to monitor the first sensor readings and the operator control signals.

5. The electrohydraulic implement pressure cutoff system of claim 1, further comprising a position sensor that provides second sensor readings that indicate a position of the first hydraulic function; and wherein the first sensor is a pressure sensor and the first sensor readings indicate a working pressure of the first hydraulic function; and wherein the control unit receives the second sensor readings, and determines whether the first hydraulic function is at or beyond an end-of-travel position using both the first and second sensor readings.

6. The electrohydraulic implement pressure cutoff system of claim 1, further comprising a position sensor that provides second sensor readings that indicate a position of the hydraulic function; and wherein the first sensor is a pressure sensor and the first sensor readings indicate a pump outlet pressure of the hydraulic pump; and wherein the control unit receives the second sensor readings, and determines whether the first hydraulic function is at or beyond an end-of-travel position using both the first and second sensor readings.

7. The electrohydraulic implement pressure cutoff system of claim 1, further comprising a position sensor that provides second sensor readings that indicate a position of the first hydraulic function; and wherein the first sensor is a pressure sensor and the first sensor readings indicate a load sense pressure of the hydraulic pump; and wherein the control unit receives the second sensor readings, and determines whether the first hydraulic function is at or beyond an end-of-travel position using both the first and second sensor readings.

8. The electrohydraulic implement pressure cutoff system of claim 1, further comprising:

a first function position sensor that provides second sensor readings that indicate a position of the first hydraulic function, the second sensor readings also being received by the control unit;

a second hydraulic function powered by the hydraulic pump; and a second function position sensor that provides third sensor readings that indicate a position of the second hydraulic function, the third sensor readings also being received by the control unit;

wherein when the first sensor readings indicate the load sense pressure is at or beyond a load sense pressure threshold, and the second sensor readings indicate the first hydraulic function is at or beyond the end-of-travel position for the first hydraulic function, and the third sensor readings indicate the second hydraulic function is not at or beyond an end-of-travel position for the second hydraulic function, then the control unit closes the first hydraulic valve to prevent flow to or from the first hydraulic function; and wherein when the first sensor readings indicate the load sense pressure is at or beyond a load sense pressure threshold, and the second sensor readings indicate the first hydraulic function is at or beyond the end-of-travel position for the first hydraulic function, and the third sensor readings indicate the second hydraulic function is at or beyond the end-of-travel position for the second hydraulic function, then the control unit does not close the first hydraulic valve to prevent flow to or from the first hydraulic function.

9. The electrohydraulic implement pressure cutoff system of claim 1, further comprising:

a second hydraulic function powered by the hydraulic pump;

a second hydraulic valve that controls flow between the hydraulic pump and the second hydraulic function; and a second sensor that provides second sensor readings that indicate a parameter of the hydraulic system, the second sensor readings also being received by the control unit;

wherein the control unit determines whether the first hydraulic function is at or beyond the end-of-travel position using at least one of the first and second sensor readings, and closes the first hydraulic valve to prevent flow to or from the first hydraulic function when the first hydraulic function is at or beyond the end-of-travel position; and wherein the control unit determines whether the second hydraulic function is at or beyond the end-of-travel position using at least one of the first and second sensor readings, and closes the second hydraulic valve to prevent flow to or from the second hydraulic function when the second hydraulic function is at or beyond the end-of-travel position.

10. The electrohydraulic implement pressure cutoff system of claim 9, further comprising a pressure sensor that provides third sensor readings that indicate a load sense pressure of the hydraulic pump, the third sensor readings also being received by the control unit;

wherein the first sensor readings indicate a parameter of the first hydraulic function; and the second sensor readings indicate a parameter of the second hydraulic function; and wherein the control unit compares the first sensor readings with a first sensor threshold, compares the second sensor readings with a second sensor threshold, compares the third sensor readings to a load sense pressure threshold; and when the first sensor readings exceed the first sensor threshold and the third sensor readings exceed the load sense pressure threshold, the control unit closes the first hydraulic valve to prevent flow to or from the first hydraulic function; and when the second sensor readings exceed the second sensor threshold and the third sensor readings exceed the load sense pressure threshold, the control unit closes the second hydraulic valve to prevent flow to or from the second hydraulic function.

11. The electrohydraulic implement pressure cutoff system of claim 10, wherein the first sensor readings indicate a position of the first hydraulic function; and the second sensor readings indicate a position of the second hydraulic function.

12. The electrohydraulic implement pressure cutoff system of claim 10, wherein:

after the control unit closes the first hydraulic valve, when the first sensor readings continue to exceed the first sensor threshold and the operator control signals continue to command the first hydraulic function in the stalled direction, the control unit keeps the first hydraulic valve closed regardless of the third sensor readings;

after the control unit closes the first hydraulic valve, when the operator control signals continue to command the first hydraulic function in the stalled direction and the first sensor readings no longer exceed the first sensor threshold, the control unit commands the first hydraulic valve to an actuated position allowing flow from the hydraulic pump to the first hydraulic function; and after the control unit closes the first hydraulic valve, when the operator control signals command the first hydraulic function away from the stalled direction, the control unit commands the first hydraulic valve to a release position allowing flow from the first hydraulic function to a hydraulic reservoir.

13. The electrohydraulic implement pressure cutoff system of claim 9, further comprising a pressure sensor that provides third sensor readings that indicate a pump outlet pressure of the hydraulic pump, the third sensor readings also being received by the control unit;

wherein the first sensor readings indicate a parameter of the first hydraulic function; and the second sensor readings indicate a parameter of the second hydraulic function; and wherein the control unit compares the first sensor readings with a first sensor threshold, compares the second sensor readings with a second sensor threshold, compares the third sensor readings to a pump outlet pressure threshold; and when the first sensor readings exceed the first sensor threshold and the third sensor readings exceed the pump outlet pressure threshold, the control unit closes the first hydraulic valve to prevent flow to or from the first hydraulic function; and when the second sensor readings exceed the second sensor threshold and the third sensor readings exceed the pump outlet pressure threshold, the control unit closes the second hydraulic valve to prevent flow to or from the second hydraulic function.

14. An electrohydraulic implement pressure cutoff method for an electrohydraulic system including a hydraulic pump, a hydraulic valve and a hydraulic function, the method comprising:

receiving operator control signals from an operator control that controls the hydraulic function;

controlling the hydraulic valve to control flow between the hydraulic pump and the hydraulic function;

monitoring a parameter of the hydraulic function using a first sensor that provides first sensor readings; and closing the hydraulic valve to prevent flow to or from the hydraulic function when the first sensor readings indicate that the hydraulic function is at or beyond an end-of-travel position in a stalled direction and the operator control signals continue to command the hydraulic function in the stalled direction.

15. The electrohydraulic implement pressure cutoff method of claim 14, wherein the first sensor is a pressure sensor and the first sensor readings indicate a working pressure of the hydraulic function; and the method further comprising:

monitoring a position sensor that provides second sensor readings that indicate a position of the hydraulic function; and closing the hydraulic valve to prevent flow to or from the hydraulic function when at least one of the first and second sensor readings indicate that the hydraulic function is at or beyond the end-of-travel position in the stalled direction and the operator control signals continue to command the hydraulic function in the stalled direction.

16. The electrohydraulic implement pressure cutoff method of claim 14, wherein the first sensor is a position sensor and the first sensor readings indicate a position of the hydraulic function; and the method further comprising:

monitoring a pressure sensor that provides second sensor readings that indicate a load sense pressure of the hydraulic pump; and closing the hydraulic valve to prevent flow to or from the hydraulic function when the first sensor readings indicate that the hydraulic function is at or beyond the end-of-travel position in the stalled direction, the second sensor readings indicate that the load sense pressure of the hydraulic pump is at or beyond a load sense pressure threshold, and the operator control signals continue to command the hydraulic function in the stalled direction.

17. The electrohydraulic implement pressure cutoff method of claim 16, further comprising:

keeping the hydraulic valve in the closed position to prevent flow to or from the hydraulic function while the first sensor readings continue to indicate that the hydraulic function is at or beyond the end-of-travel position in the stalled direction and the operator control signals continue to command the hydraulic function in the stalled direction;

opening the hydraulic valve to allow flow from the hydraulic pump to the hydraulic function, when the operator control signals continue to command the hydraulic function in the stalled direction and the first sensor readings indicate that the hydraulic function is no longer at or beyond the end-of-travel position in the stalled direction; and moving the hydraulic valve to allow flow from the hydraulic function to a hydraulic reservoir, when the operator control signals command the hydraulic function away from the stalled direction.

18. An electrohydraulic implement pressure cutoff method for an electrohydraulic system including a hydraulic pump, a hydraulic valve and a hydraulic function, the method comprising:

receiving operator control signals from an operator control that controls the hydraulic function;

monitoring a pressure of the hydraulic system using a pressure sensor;

entering a no operator command mode when no function control signals are received;

entering a normal operating mode when function control signals are received and the monitored pressure of the hydraulic system is below a pressure threshold;

in normal operating mode, generating valve commands for the hydraulic valve based on the operator control signals;

entering a pressure cutoff mode when the operator control signals indicate increased flow to the hydraulic function and the monitored pressure of the hydraulic system is greater than or equal to the pressure threshold;

in pressure cutoff mode, closing the hydraulic valve to prevent flow to or from the hydraulic function.

19. The electrohydraulic implement pressure cutoff method of claim 18, further comprising:

monitoring a position of the hydraulic function using a position sensor;

entering the normal operating mode when the operator control signals are received and the position of the hydraulic function is below a position threshold; and wherein entering the pressure cutoff mode also requires the position of the hydraulic function to be greater than or equal to the position threshold.

20. The electrohydraulic implement pressure cutoff method of claim 18, further comprising:

monitoring a position of the hydraulic function using a position sensor;

entering the pressure cutoff mode when the operator control signals indicate increased flow to the hydraulic function and the position of the hydraulic function is greater than or equal to a position threshold; and wherein entering the normal operating mode also requires the position of the hydraulic function to be below the position threshold.

* * * * *